US005931393A

United States Patent [19]

Alsip et al.

[11] Patent Number: 5,931,393

[45] Date of Patent: Aug. 3, 1999

[54] SALT-SAND SPREADER WITH LIQUID INJECTOR

[75] Inventors: Charles E. Alsip; John P. Ellingson, both of Benson; Harvey E. Hoffman, Danvers; Jack D. Messner, Wayzata; David G. Trooien, Willmar, all of Minn.

[73] Assignee: Iboco, Inc., Benson, Mich.

[21] Appl. No.: 08/874,799

[22] Filed: Jun. 13, 1997

Related U.S. Application Data

[63] Continuation of application No. 08/373,867, Jan. 17, 1995, abandoned, which is a continuation of application No. 08/270,118, Jul. 1, 1994, abandoned, which is a continuation of application No. 07/866,729, Apr. 10, 1992, abandoned.

[51] Int. Cl.[6] ..... E01H 10/00

[52] U.S. Cl. ..... 239/654; 239/662; 239/675; 239/677; 239/689

[58] Field of Search ..... 239/654–657, 239/662, 672, 675, 677, 689

[56] References Cited

U.S. PATENT DOCUMENTS

| | | | |
|---|---|---|---|
| Re. 33,835 | 3/1992 | Kime et al. | 239/684 |
| 2,062,294 | 12/1936 | Cary et al. | 239/655 |
| 2,487,503 | 11/1949 | Witter | 239/654 |
| 2,496,504 | 2/1950 | Tarrant | 239/654 |
| 2,844,914 | 7/1958 | Finn | 239/654 |
| 3,171,658 | 3/1965 | Clark | 239/687 |
| 3,539,113 | 11/1970 | Tyler | 239/684 |
| 3,552,659 | 1/1971 | Meyer | 239/657 |
| 3,756,509 | 9/1973 | Hamnes | 239/675 |
| 4,886,208 | 12/1989 | Strand | 239/662 |
| 4,898,333 | 2/1990 | Kime et al. | 239/684 |
| 5,052,627 | 10/1991 | Balmer | 239/656 |
| 5,318,226 | 6/1994 | Kime et al. | 239/677 |

FOREIGN PATENT DOCUMENTS

| | | | |
|---|---|---|---|
| 3712452 | 11/1988 | Germany | 239/662 |

OTHER PUBLICATIONS

"The Epoke S 3500 Series" by Thomsen Products, Inc., Windsor, CT (date unknown).
"The Ice Control Spray Systems" by Reed Systems, Ltd., Ellenville, N.Y. (date unknown).
"The Swenson Spreader Electric Model" by Swenson (date unknown).
"The Swenson Spreader Hydraulic Model" by Swenson (date unknown).
"Epoke PWB–H" by Thomsen Products, Inc., Windsor, CT (date unknown).
"Syn–Con Pre–Moistening Liquid Controller", Bristol Co., Granby, CT (date unknown).
"Syn–Con EHR 2400" by Syn–Con Bristol Co., Granby, CT (date unknown).
"Syn–Con 2400 Advantages" by Syn–Con Bristol Co., Granby, CT (date unknown).
"Syn–Con GSI 3000 Overhead" by Syn–Con Bristol Co., Granby, CT (date unknown).
"Syn–Con GSI 3000 Advantages" by Syn–Con Bristol Co., Granby, CT (date unknown).
"Syn–Con DS2–Q Overhead" by Syn–Con Bristol Co., Granby, CT (date unknown).
"Syn–Con DS2–Q Advantages" by Syn–Con Bristol Co., Granby, CT (date unknown).

*Primary Examiner*—Kevin Weldon
*Attorney, Agent, or Firm*—Westman, Champlin & Kelly, P.A.

[57] ABSTRACT

A salt-sand spreader for use for spreading materials onto road surfaces primarily where icing or slippery conditions occur. The spreader includes an applicator for coating the particles with a liquid prior to discharging the particles to tend to speed up the ice melting reaction and if a suitable coating is used to inhibit corrosive action of the salt. Additionally, the velocity of discharge of the particles from a discharge mechanism is sensed or correlated to fan speed and the discharge velocity is adjusted to match the forward speed of the vehicle so that there is essentially zero relative velocity between the particles and the ground when the particles strike the ground.

12 Claims, 7 Drawing Sheets

10
12
13
14
16
18
20
21
22
32
79
96
S
HOIST

SALT-SAND SPREADER WITH LIQUID INJECTOR

This is a continuation of application Ser. No. 08/373,867, filed Jan. 17, 1995, now abandoned which is a continuation of Ser. No. 08/270,118, filed on Jul. 1, 1994, now abandoned, which is also a continuation of Ser. No. 07/866,729, filed on Apr. 10, 1992, now abandoned.

BACKGROUND OF THE INVENTION

The present invention relates to a salt-sand spreader which will coat particles with a liquid as the particles are discharged to inhibit corrosive action of salt as well as to provide for an initial acceleration of melting of ice on a roadway.

At the present time in cold climates, it is common for highway departments to spread large amounts of salt, and salt-sand mixtures during freezing weather when packed snow and ice accumulate on roadway surfaces in order to melt away the ice and avoid excessive slippery conditions.

When salt is deposited, the reaction with ice takes some time before the ice forms a solution that is sufficiently concentrated to remain liquid at temperatures below the melting point of ice. Additionally the salt solution liquid is highly corrosive, and has long been a source of damage to automobiles and other vehicles by causing rust.

Another problem with existing spreaders, which generally use a disk-type rotor rotating about a generally upright axis is that the particles will bounce on the roadway and not remain in the position desired. This is primarily caused by differentials in speed between the particles and the road surface when they strike the surface. While tremendous volumes of sand and salt are spread on the roadways each year, the problems associated with such spreading, and which further include environmental damage, have been unsolved. U.S. Pat. No. 4,886,208 teaches applying a liquid to fertilizer particles that are carried in a fluid in tubes.

SUMMARY OF THE INVENTION

The present invention relates to a spreader which provides for a uniform feed of a particulate material that can, as disclosed, be salt, or partial mixes of sand and salt for treating freezing icy roadways. The particles are dropped into an air discharge venturi so that the particles are carried in a fluid stream. A suitable liquid coating agent is injected into the venturi to coat the particles of sand and salt prior to depositing them on the roadway surface. The liquid coating can be designed to shorten the time from when the particles strike the roadway and the start of the de-icing process, as well as providing corrosion resistance in certain instances.

In the preferred form, the spreader mounts onto the rear of a dump truck box in place of the tailgate, as do conventional salt-sand spreaders presently in use. The device of the present invention includes a delumper feeder bar that breaks up lumps as the material particles are received from the body, and a transversely extending auger which meters and feeds the material to one side of the truck box, and thus to one end of the auger. The particulate material is dropped through a chute into an air-mixing chamber. A suitable quantity of air is passed through this venturi type mixing chamber so that the particles are entrained in the air. Preferably within the same housing, a liquid that is metered through a pressure pump and discharged through an injector of suitable size is permitted to flow into the air-particulate material mixture (which can be salt and sand) before the particles are discharged downwardly in a desired pattern.

The present device thus provides an apparatus for adding liquid to a salt-sand mixture, by coating the particles with the liquid. Such liquids could comprise a salt brine that coats the particles to quickly aid in the start of a de-icing process by providing salt solution immediately. Products such as methanol also can be used as a de-icing accelerator, and proprietary liquid materials developed for inhibiting rust and reducing corrosion problems on vehicles can be added. Additionally, a velocity sensor is utilized for determining the discharge velocity of the particulate material and/or air in rearward direction, and a sensor is utilized also for sensing the vehicle speed. The air velocity is adjusted by adjusting the speed of a fan used in order to match the rearward velocity of the air-particle mixture and the forward speed of the vehicle so that there is essentially zero relative velocity between the particles being discharged and the road surface on which the particles are dropped.

The unit is easily utilized on existing trucks, and provides an accurate and readily adjustable way of minimizing the amount of salt-sand needed, and for adding liquid coatings to the particles being discharged.

DETAILED DESCRIPTION OF THE PREFERRED EMBODIMENTS

A dump truck indicated generally at 10 is of conventional design and has a box 12, which is only schematically shown, but which is a dump-type box which pivots about a pivot axis indicated at 13 relative to a truck fame 14, through the use of a power hoist indicated schematically at 16. This is a conventional dump body so that the floor of the truck box 12 will incline as the box is pivoted and the front raises, and material in the box will tend to slide along the floor toward a tailgate end indicated generally at 18.

Figure 3:
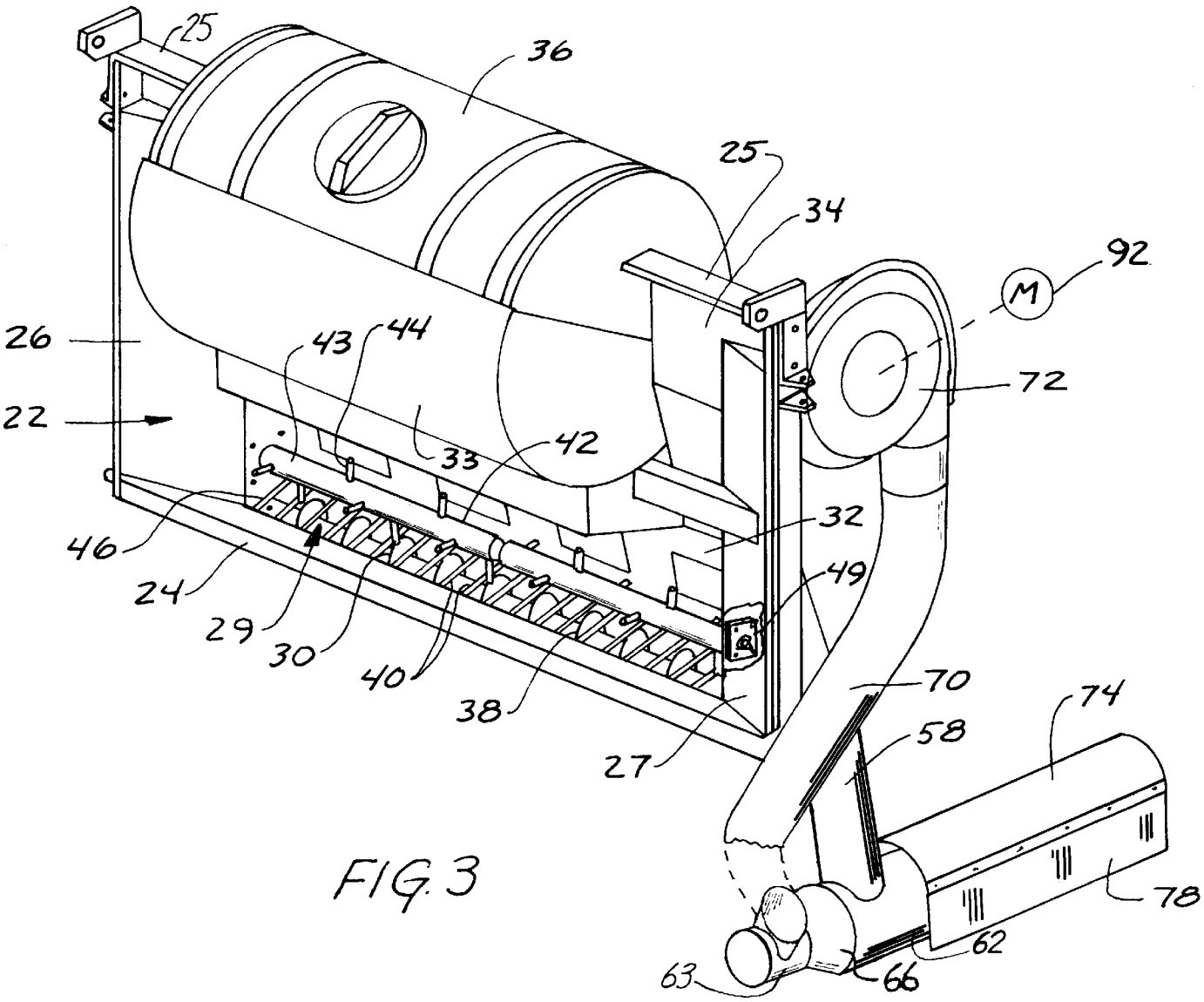
FIG. 3 is a perspective view of the salt-sand spreader of the present invention.
Figure 4:
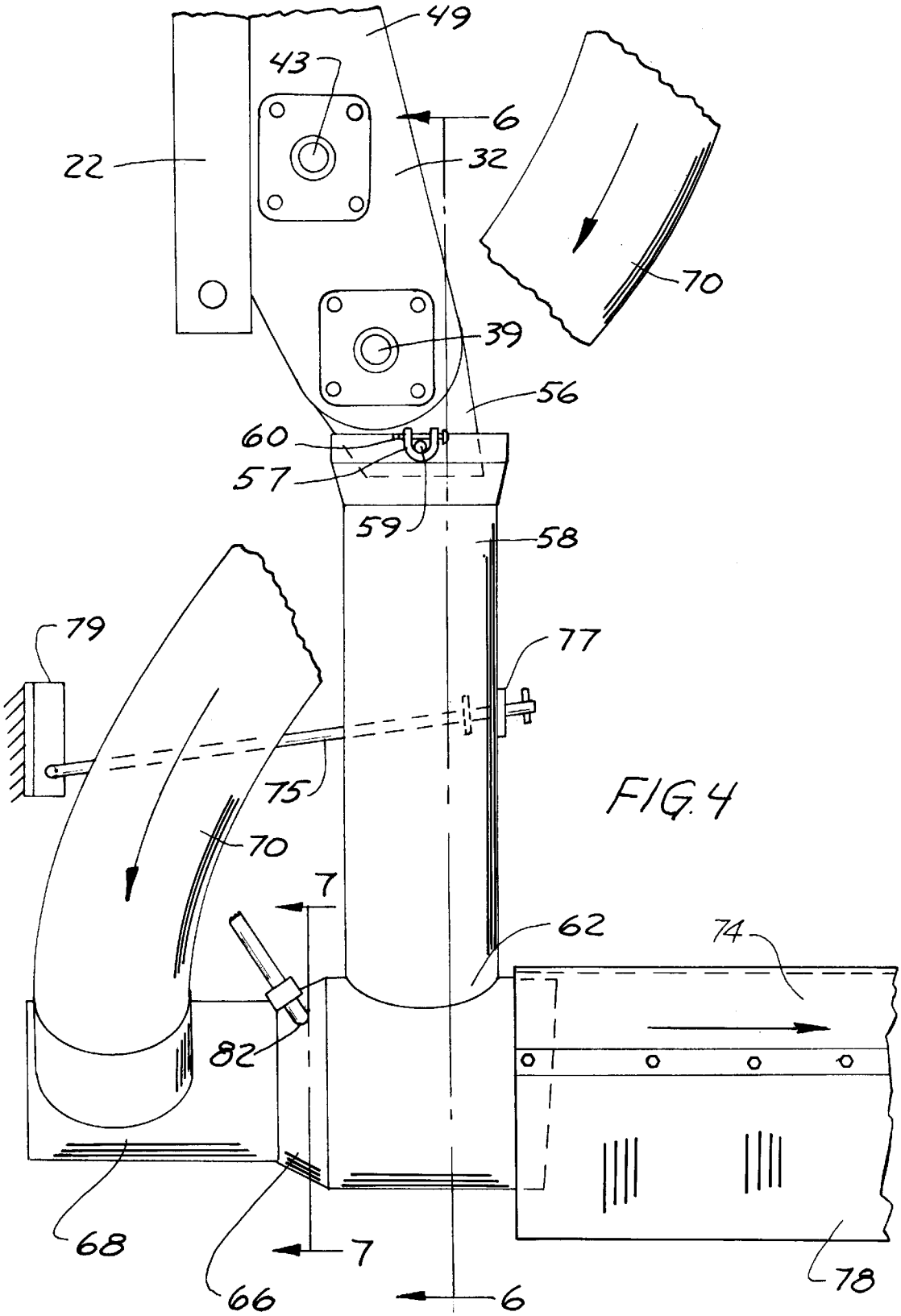
FIG. 4 is an enlarged, proprietary side view of the discharge portions of the spreader.

A salt-sand spreader indicated at 20 made according to the present invention is pivotally mounted on suitable pins 21 on opposite side walls of the box 12 in place of the normal tailgate. The spreader is latched in position for use, but can be reversed when it is not needed. The spreader includes a tailgate panel 22 which is supported with cross-frame members 24 at the bottom and center parts, and has a frame assembly 25 at the top. The tailgate panel includes a panel section 26 on one side, and a shorter panel section 27 on the opposite side. As shown in FIG. 3, these panels 26 and 27 taper toward a receptacle or auger opening 29. The auger is mounted in an auger housing panel 32 that joins a tank support housing 33, which is a part cylindrical housing that forms a solid wall and joins with the end panel 26. A filler panel 34 illustrated in FIG. 3 is also used to provide a solid tailgate except for the auger opening 29. The tank housing 33 is used for mounting a liquid supply tank 36. The auger housing 32 may have observation windows 35 formed therein, if desired.

Figure 1:
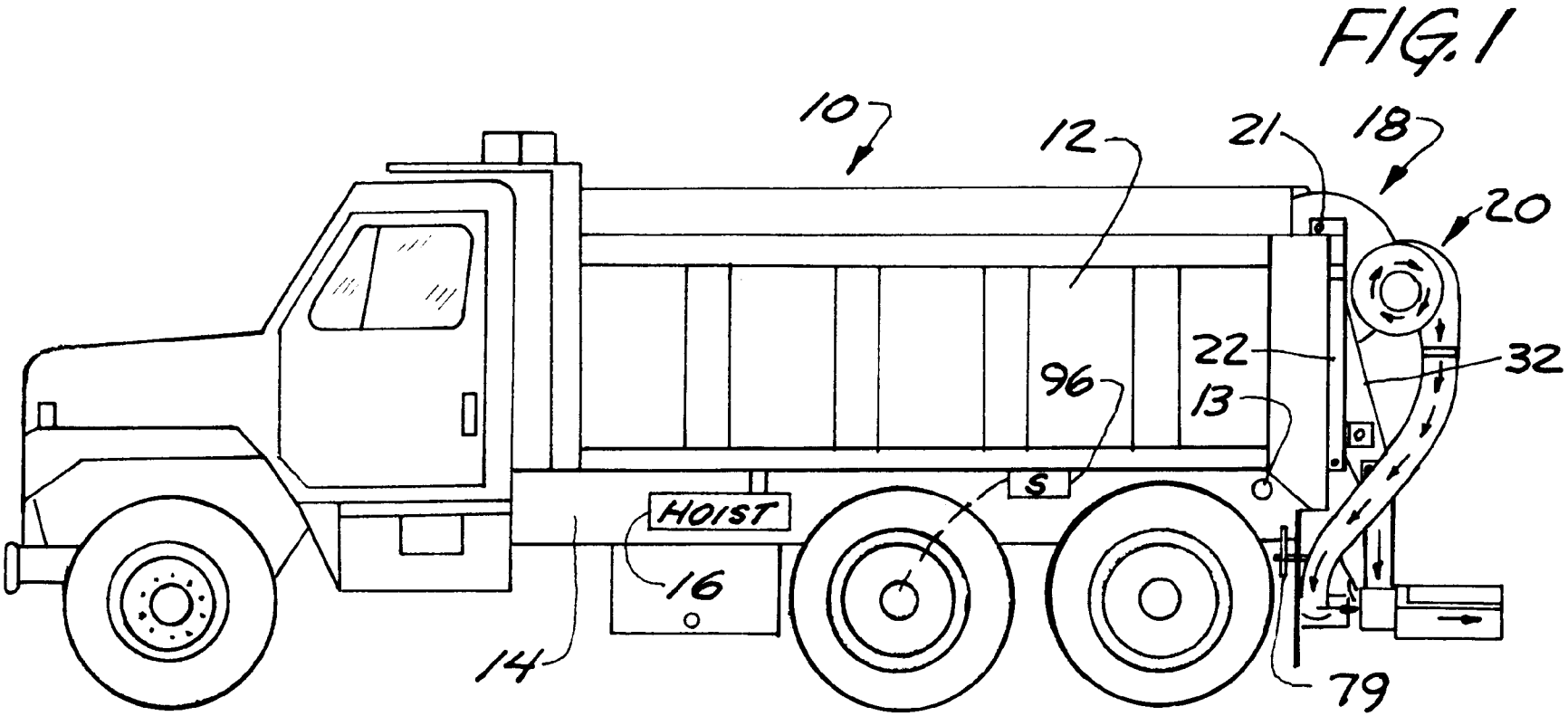
FIG. 1 is a side-elevational view of a dump truck shown schematically, and having a salt-sand spreader made according to the present invention installed thereon.

The auger housing 32 is tapered outwardly from the top as can be seen in FIG. 1, so that at its lower portion it is part cylindrical to house the rotatable auger 30 in a normal manner. The auger has helical flights 38 mounted on an auger shaft 39. The auger housing has debris guard bars 40 spanning the top of the auger trough, and providing support, as well as keeping large objects which may fall into the truck box from the auger.

The auger 30 is rotatably mounted between a pair of end panels including an end panel 46 that joins the panel 26, and an end panel 49 at the discharge end of the panel. The ends of auger shaft 39 extend to be received in bearings in the end panels 46 and 49. The end of the auger 30 adjacent panel 49 will discharge material into a collection tube, as will be explained.

A delumper bar or a lump-breaking beater bar 42 is rotably mounted above the auger and guard bars. This lump-breaking bar comprises a tube 43 which has a number of radially extending fingers 44 thereon. The delumper or beater bar 42 is rotatably mounted in end panels 46 and 49 as well. Panel 49 joins panel 27 at its lower portions. Suitable braces are, of course, provided for adequate strength.

The auger 30 is a helical auger of conventional design. Shaft 39 extends out through a bearing panel 46 and is driven by a hydraulic motor 50 mounted to the exterior of the panel 46 and powered through a suitable valve 52 shown schematically in FIG. 2. The motor 50 is an adjustable-speed motor that can be controlled automatically, or in response to operator inputs. The delumper can also be driven by a separate hydraulic motor, such as 50, or may be driven with a chain and sprocket drive represented schematically at 51 (FIG. 2) extending between the output shaft of the hydraulic motor 50 (which is directly coupled to the auger center tube or shaft) and a shaft that is drivably connected to and coaxial with the center tube 43 of the delumper bar 42.

Figure 2:
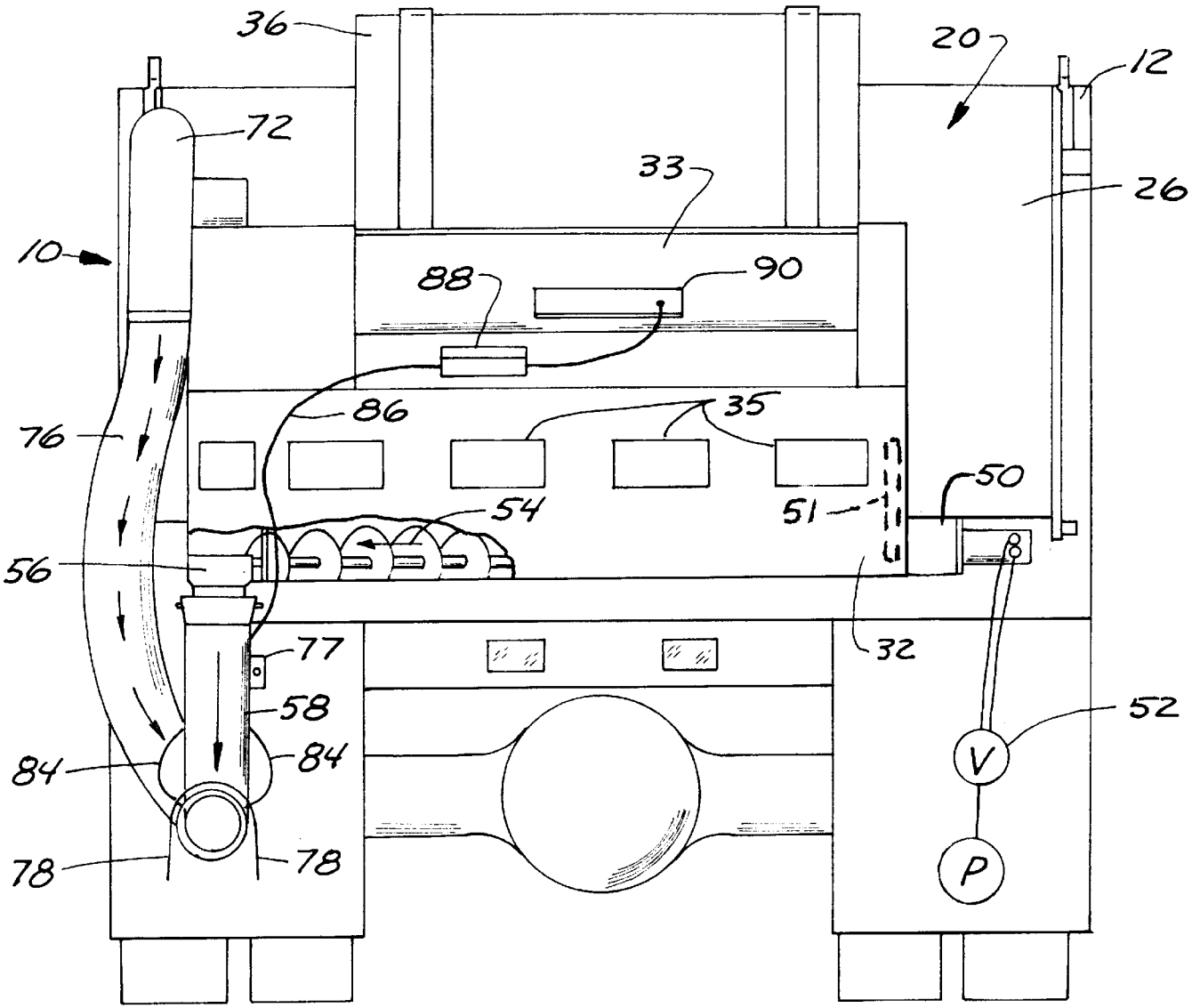
FIG. 2 is an enlarged rear view of the salt-sand spreader of the present invention.

When the auger 30 is driven by the motor 50, the particulate material, which comprises a desired mixture of particulate salt and sand in most instances, and which is classified so that it is proper particle size, is conveyed by the auger 30 laterally along its length in direction away from the motor 50 and support panel 46, and generally as shown by the arrow 54 in FIG. 2. The salt-sand material is thus discharged into a chute assembly 56 that is at the end of the auger housing 32 opposite from panel 46.

Figure 5:
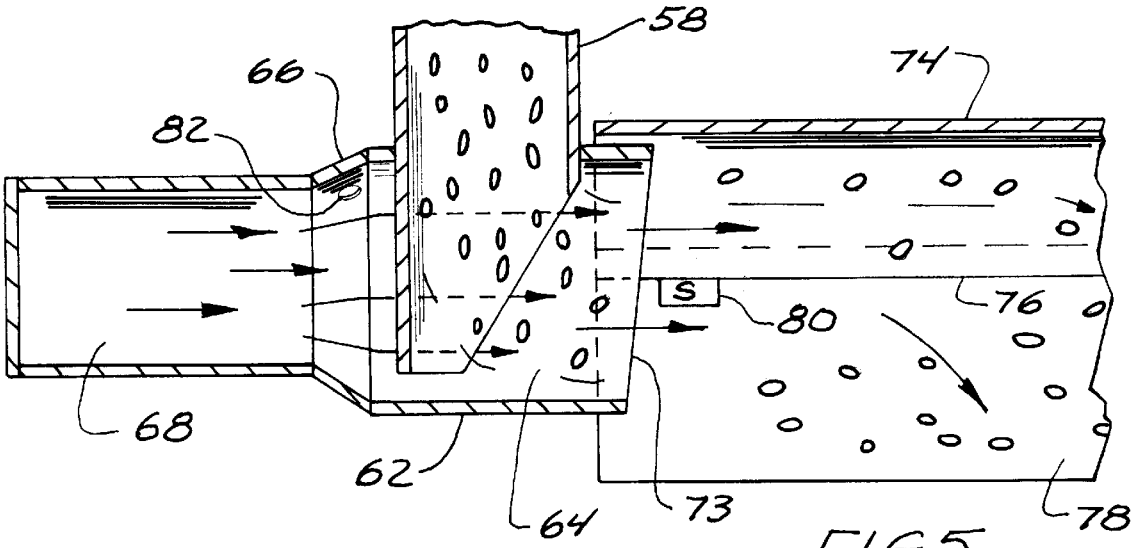
FIG. 5 is a part schematic side sectional view through a chamber in which air is introduced into the particulate material to "fluidize" the material.
Figure 6:
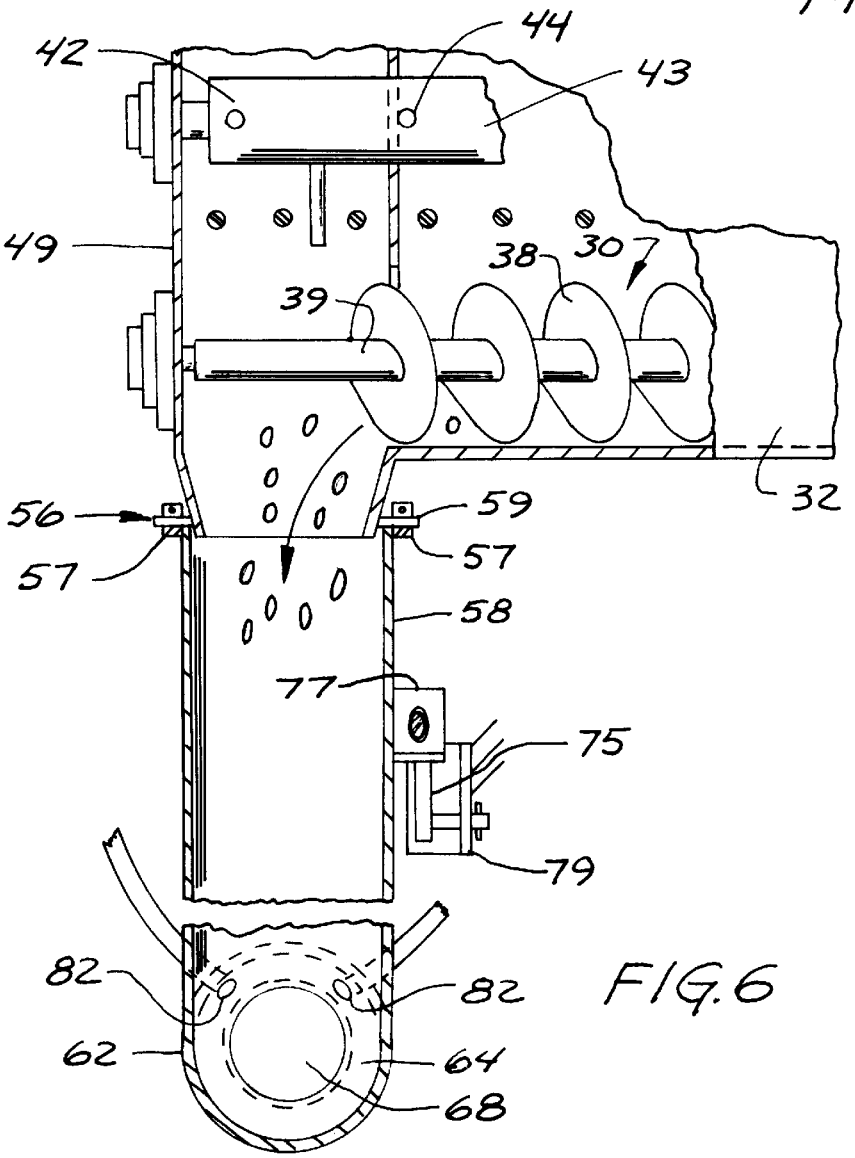
FIG. 6 is a sectional view taken along lines 6—6 in FIG. 4.
Figure 7:
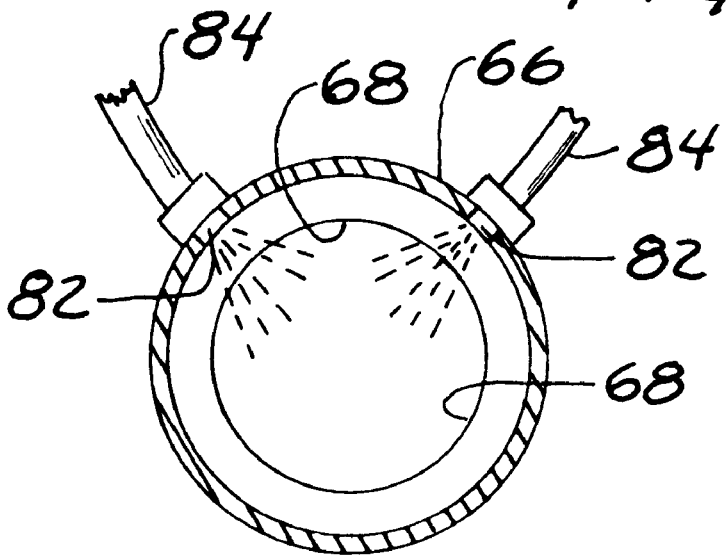
FIG. 7 is a sectional view taken as on line 7—7 in FIG. 4.
Figure 8:
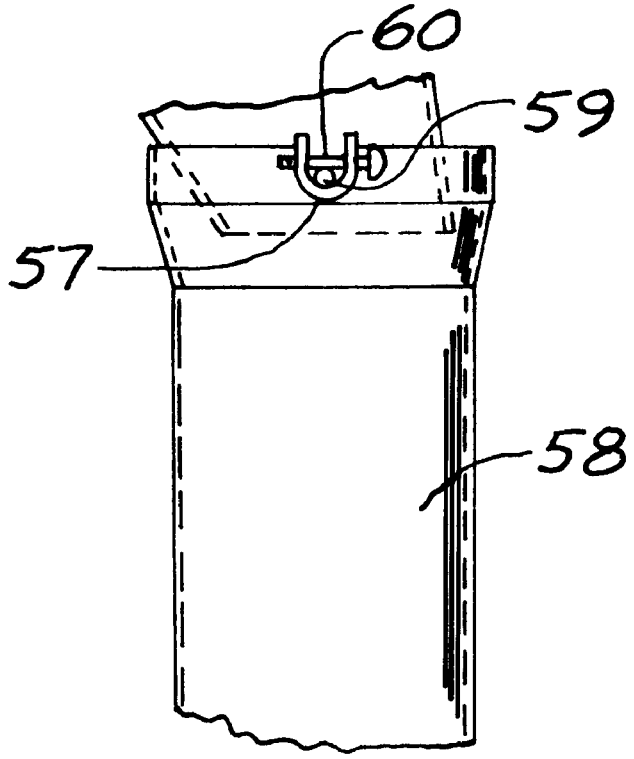
FIG. 8 is an enlarged fragmentary side view of the pivot connection of the vertical material discharge pipe.

The chute assembly 56 is supported on to the auger housing 32 at one end, as can be seen, and pivotally supports a vertical discharge pipe 58 through suitable pivot pins 59 that fits into a saddle 57 on each side of the pipe 58. The saddles are held on the pins 59 with quick clip cotter pins 60 so the pipe 58 can be removed and replaced readily. The pins support the pipe for pivotal movement. The tube 58 is fixed to and supports a venturi housing 62 at the bottom end. The venturi housing 62 can be suitably attached to pipe 58, or can be independently supported, and has a generally horizontal axis. The venturi housing includes a mixing chamber 64 into which the pipe 58 opens. Particles carried by the auger 30 and dropped into the pipe 58 will drop into mixing chamber 64. The housing venturi has a transition section 66 (FIG. 5), and an air inlet section 68 which is formed as a conduit elbow.

The air inlet section 68 is connected to an air flow tube 70 that leads from a blower fan 72 that is mounted onto the tailgate assembly 20. The outlet end 73 of the venturi is open, as can be seen, and has a half cylindrical housing 74 over the upper part thereof. The half cylindrical housing has lower edges 76 on which are mounted flexible skirts 78 that extend back to the rear end of the housing 74. The flexible skirts 78 form a shroud or passageway for the material being discharged to flow rearwardly and be guided into a relatively defined path as the particles drop toward a road surface.

The tube or pipe 58 is pivotally mounted to the fixed chute assembly and is controlled as to position about the pivot so it remains substantially vertical when the dump box is tilted during use. A control link 75 is slidably mounted through an opening in a bracket 77 fixed to pipe 58. The link has stop nuts on opposite sides of the bracket 77 so there is some lost motion and the link can pivot in the opening in the bracket. The opposite end of the control link is universally pivotally mounted to a bracket 79, which is fixed to the truck frame. The pivot of link 75 to the truck is positioned so that as the front of the truck box is raised the pipe will be controlled to pivot and remain substantially vertical.

The goal is to keep housing 74 and skirts 78 oriented parallel to the road surface. While the pivot pins 59 will lower somewhat as the truck box tilts, the orientation of the housing 74 will not change substantially.

On the interior of the flexible skirts 78, adjacent the venturi assembly (or in the venturi assembly), a suitable sensor 80 can be mounted for determining air velocity of the air flow rearwardly from the venturi. The sensor 80 could preferably be a type of small radar unit now available that measures the actual speed of the particles discharged, or can be an air flow sensor that measures the flow of air with a probe that protrudes into the air-particle stream.

The transition section 66 houses a pair of liquid injectors 82 on opposite sides of a vertical center plane. These injectors 82 are made to inject into the venturi a suitable metered quantity of liquid material, which moves along the walls of the venturi and in the air as urged by the air stream. The sand-salt particles dropping into the air stream are coated as the liquid is carried with the air and mixed to cover the particles as the air and the particles are mixed and moved adjacent the injectors 82 in the venturi mixing chamber 64. The injected liquid will adhere to and cover the particles and provide a coating for desired purposes.

The injectors 82 in turn are connected to liquid-carrying lines 84, which are both joined to a common liquid line 86. Line 86 is connected to the output of a metering pump assembly 88, which in turn is connected to a suitable connection 90 leading to the tank 36. The pump 88 is driven to meter liquid into the line 86 and thus into the lines 84 at a desired, and selectable rate.

The fan 72 is driven by a variable speed motor, preferably a hydraulic motor as shown schematically at 92, so that the rate of discharge of air can be adjusted and thereby the velocity of air discharged from the venturi housing 62 can be adjusted. The fan speed is preferably controlled from the velocity sensor 80 by providing a feedback to the motor 92 until the air velocity is matched with the speed of the vehicle detected by a vehicle speed sensor 96, (see FIG. 1). The vehicle speed sensor 96 is any suitable sensor for determining ground speed. By matching the relative speeds of air and vehicle and adjusting the speed of the fan motor 92 so that the air velocity is substantially the same as the ground speed of the vehicle, (but in opposite direction) the particles are traveling at substantially zero velocity relative to the road surface and will not scatter and bounce to the degree normally encountered. This control of speed tends to reduce waste and control the drop location of the particles. Likewise, the pump 88 for injecting liquid, and the motors for the auger 30 and, if used, for the delumper bar 42 are all variable speed and vary as a function of the forward speed to the vehicle to provide the desired amounts of the granular material for each mile traveled (pounds per mile).

In addition to sensing the air velocity, a feedback also can be utilized for sensing fan speed, with a known relationship between fan speed and air velocity being programmed into a suitable memory. The relationship of fan speed (RPM) and outlet velocity can be stored in a look-up table in the memory so the fan speed can be adjusted to achieve the desired air velocity. The fan speed can be adjusted to be the appropriate speed for providing a corresponding air velocity that has been determined to be equal to the forward speed of the vehicle.

Figure 9:
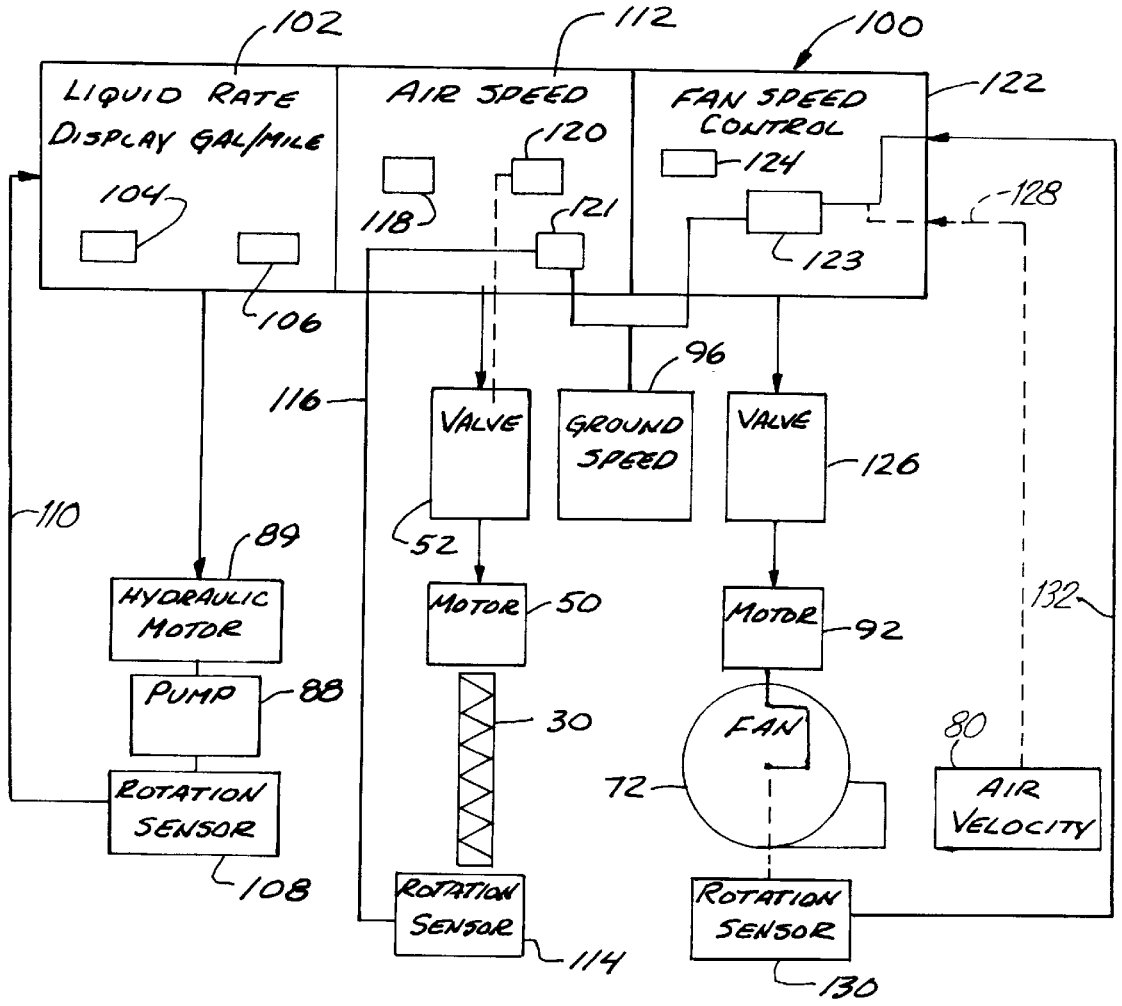
FIG. 9 is a schematic representation of a typical control arrangement used with the present invention.

FIG. 9 is a schematic representation of the control system utilized with the present invention. A controller indicated generally at 100 essentially has three channels of control and can utilize suitable memory for digital controls and for providing operator input.

The controllers can be those available from Dickey-John Corporation, their Model ICS 2000. The individual channels each require a separate controller section, but these control sections can be part of a multi-channel controller.

The first section of the controller 100 is indicated at 102 and controls the volume of liquid introduced into the salt-sand mixture for a known amount of particulate material. A suitable rate set control indicated at 104 can be provided, and a manual override control 106 can be used if desired. The controller 102 controls a variable speed motor 89 which can be hydraulic or electrical and which drives the liquid metering pump 88.

A sensor 108 can be used for sensing the rotational speed of the liquid pump and for providing a feedback signal along the line 110 to the controller 102 so that the desired speed set by the operator select 104 is maintained. Also, a flow sensor can be placed in the pump output line so direct flow measurement can be used for feedback.

A second control section 112 is used for the auger 30, and thus the delumper. In this case, the hydraulic motor 50 and hydraulic control valve 52 are illustrated. The hydraulic control valve is controlled by signals from the control section 112. The auger 30 also has a rotational speed sensor 114 associated therewith, which provides a feedback along a line 116 to ensure that the control valve 52 is adjusted to provide the proper speed to the motor 50. This controller also can have an operator rate set control 118 (pounds per mile) for selecting the auger speed. An operator override or blast function button 120 can be provided for accelerating the speed of the hydraulic motor and overriding the rate set with control 118. This provides a "blast" of the sand, salt or salt-sand mixture where the operator sees more is needed. Curves, or places where ice buildup is greater can be given a greater amount. A ground speed input from the sensor 96 is also used and provided to a comparator 121 that compares the vehicle signal with a properly conditioned auger speed feedback to provide a control signal that maintains the auger speed correctly set for metering for ensuring that the auger speed is adjusted to achieve the desired rate of pounds per mile. Calibrations can be made and programmed into the controller 112 as desired.

A third section 122 of the controller 100 can be utilized for controlling the speed of fan 72. The motor 92 for the fan is illustrated. The control section 122 has an operator select button 124 that permits adjusting the relationship of fan speed to vehicle speed.

The controller 122, however, is programmed to use an external feedback to adjust the air velocity, and thus the particle velocity, to be equal to the ground speed of the truck. The ground speed sensor 96 is connected to a comparator 123 in the controller 122, and the controller provides a comparison with feedback signals to adjust a variable control valve 126 for controlling the speed of the hydraulic motor 92 and thus the speed of the fan 72, which has a known relationship to the output velocity. Thus, feedback sensor 80, which measures either air velocity or particle velocity, is provided with a feedback line 128 to the comparator 123, and also (or alternatively), a rotational speed sensor 130 can be provided on the fan to provide a selectable feedback signal along a line 132 to the comparator in the controller. The controller 122 or the rotational sensor 130 can be programmed for providing a signal that will accommodate the non-linear relationship of fan rotation and speed and air velocity from the fan 72. However, the relationship of air velocity on the output and the speed of rotation of the fan is known by calibration or other means, and thus suitable programming for obtaining this non-linear relationship of air flow to fan speed can be provided. The controller compares the air velocity feedback with the truck ground speed signal and adjusts the need of motor 92 through valve 126 to match the speeds within tolerances of the controls.

Thus, the controller 100 can be programmed so the particles will be fed at a desired rate, and the liquid being used for coating the particles also can be fed at the desired relationship to the amount of particulate material.

The spreader will spread salt, sand, or a standard mixture of salt and sand in each truckload on icy roads. The particles will be prewetted by the liquid that is being added to increase melting capability, or if the liquid is capable of so doing, reducing corrosion. As can be seen the spreader unit mounts easily on the back of a standard dump truck box. The material is applied to the road surface at a zero relative velocity within suitable tolerances, so that the particle bounce and loss is reduced.

Normally salt and sand will be applied at rates of pounds per mile. A 50—50 ratio sand and salt, for example, will be applied generally between 100 to 800 pounds per mile for one traffic lane.

Salt has a density of approximately 48 pounds per cubic foot, while sand has a density of 90 to 105 pounds per cubic feet, so the overall density of the ratio that is being distributed can be determined. Under a typical or standard condition, using a five percent by weight amount of liquid relative to the sand-salt mixture, and a 500 pound per mile salt-sand application rate, one will apply 25 pounds per mile of the wetting agent or liquid. Figuring 11 pounds of liquid per gallon, and an application speed of 50 miles per hour, a maximum wetting agent application rate will be 1.9 gallons per minute. This is well within the delivery range of the motor and pumps selected.

While an auger conveyer has been illustrated for metering the mixture that is to be deposited into the venturi where liquid will be applied by permitting it to flow along the walls to coat the particles, other conveyors can be used. For example, chain or belt metering conveyors are conventionally used.

The additional rate of feeding salt and sand with a "blast" feature permits the operator to select greater amounts of material on intersections and curves of the road where more material is needed. A separate switch could be mounted on the steering wheel for thumb actuation by the operator.

A metering pump for adding the liquid can be slaved to the hydraulic motor for running the auger if desired, rather than having a separate control, and then an adjustment made for the percentage of salt-sand in the mixture being applied so that the appropriate rate of application of the liquid would be obtained for a given rate of feed of the particulate material.

Suitable readouts on the controls can be utilized, of course, to determine the rates, speeds, error of actual function from desired, and the like. Alarm systems can be provided for showing low products in the tank or in the box of the truck.

More than one mixing chamber and outlet can be provided across the width of the spreader. The metering means can be split to deliver to the opposite sides of the spreader, if desired. Each discharge side can be individually controlled if desired, or the discharge can be under the control of one controller.

Although the present invention has been described with reference to preferred embodiments, workers skilled in the art will recognize that changes may be made in form and detail without departing from the spirit and scope of the invention.

What is claimed is:

1. A mobile spreader for spreading particulate material coated with a liquid coating as the mobile spreader moves at a velocity, comprising a supply of particulate material:

a mixing chamber for receiving the particulate material, and a flow of air in said chamber for carrying the particulate material toward and through an outlet and being directed rearwardly of the mobile spreader from the outlet as it moves;

a liquid applicator applying a liquid material to coat the individual particles as the material moves toward the rearwardly facing outlet in the chamber to enhance a function of the particles when discharged; and a flow controller for adjusting the rearward velocity of the flow of air such that the velocity of the particulate material moving through the outlet is substantially equal to the velocity of forward movement of the mobile spreader on which the chamber and applicator are mounted.

2. The spreader as specified in claim 1, wherein the liquid applicator applies a liquid material to enhance the ability of the particles to cause melting of ice on a surface on which the particulate material is discharged.

3. The spreader as specified in claim 1 wherein the applicator for applying liquid material opens to a wall of the mixing chamber and causes an injection of liquid material into the particulate material carried in the flow of air in the mixing chamber.

4. The spreader as specified in claim 1 wherein the mixing chamber comprises a venturi unit having a tapered section that expands in direction of air flow, and wherein the applicator comprises liquid injectors mounted on the tapered section.

5. The spreader of claim 4 wherein the particulate material is dropped into the mixing chamber generally along an axis of movement that is substantially perpendicular to the axis of movement of air through the venturi mixing chamber, and wherein the particulate material is dropped into the flow of air down stream from the injectors.

6. The spreader of claim 1 wherein the spreader comprises a housing mounted at an open end of a storage box capable of being tilted, laterally directed metering means for receiving particulate material from the storage box and metering and moving particulate material toward one side of the housing, and a conduit for directing particulate material from the metering means into the mixing chamber.

7. The spreader of claim 6 wherein the metering means comprises a rotatable auger, and a rotating beater spaced above and parallel to the auger for breaking up lumps of the particulate material.

8. A spreader for particulate material from a storage tank of a mobile vehicle moving in a forward direction including:

means for metering the particulate material;

means for entraining the particulate material in a rearwardly directed air stream and for discharging the particulate material at a rearwardly facing outlet from the means for entraining and in a rearward direction;

means for determining the velocity of the particulate material-air stream as it moves through the means for entraining;

means for sensing the forward speed of a mobile vehicle on which the means for entraining is mounted; and means for adjusting the particulate material-air stream velocity to substantially match the velocity of the particulate material to the forward velocity of the mobile vehicle, with the particulate material-air stream velocity being in a rearward direction opposite from the forward direction of the mobile vehicle.

9. The spreader of claim 8 and means for adding a liquid coating to the particulate material in the means for entraining and prior to discharging of the particulate material.

10. A mobile spreader having a front and a rear, and used for spreading particulate material coated with a liquid coating as the mobile spreader moves at a velocity, comprising a supply of particulate material:

a storage box mounted on the mobile spreader holding the supply of particulate material and having an opening at a rearward end;

a housing mounted adjacent the opening at the rearward end of the storage box;

laterally directed metering means for receiving particulate material from the storage box and metering a moving particulate material toward one side of the housing;

a mixing chamber for receiving the particulate material from the housing through a conduit that directs particulate material from the metering means into the mixing chamber, and a flow of air in said chamber for carrying the particulate material toward and through an outlet;

a liquid applicator applying a liquid material to coat the individual particles to enhance a function of the particles when discharged; and a flow controller for adjusting the velocity of the flow of air such that the velocity of the particulate material moving through the outlet is substantially equal to the velocity of movement of the mobile spreader on which the chamber and applicator are mounted.

11. The spreader as specified in claim 10 and a fan for providing the flow of air to the mixing chamber, means for controlling the speed of the fan, and the flow controller including first means for determining the velocity of air from the fan at different fan speeds, and a sensor for determining the velocity of the mobile spreader, the means for controlling the speed of the fan being operable in response to the first means and the sensor to provide the desired air flow velocity through the outlet.

12. The spreader as specified in claim 11 wherein said first means comprises a separate sensor adjacent an outlet from the mixing chamber for sensing the velocity of the particulate material being discharged from the mixing chamber.

* * * * *